US005570639A

United States Patent [19]

Hooper et al.

[11] Patent Number: 5,570,639

[45] Date of Patent: Nov. 5, 1996

[54] ANTI-RUNAWAY APPARATUS AND METHOD FOR A POWER-AND-FREE CONVEYOR SYSTEM

[75] Inventors: Richard G. Hooper, Southfield; Robert E. Mahu, Eastpointe; Thomas A. Moroney, Troy, all of Mich.

[73] Assignee: FKI Industries Inc., Fairfield, Conn.

[21] Appl. No.: 540,742

[22] Filed: Oct. 11, 1995

[51] Int. Cl.[6] ..... B61K 7/00; B61B 10/00

[52] U.S. Cl. ..... 104/251; 104/172.4; 104/249; 104/252; 188/62

[58] Field of Search ..... 104/172.1, 172.3, 104/172.4, 249, 250, 251, 252; 198/502.4; 188/35, 62, 72.2, 72.7, 346

[56] References Cited

U.S. PATENT DOCUMENTS

| | | | |
|---|---|---|---|
| 1,894,728 | 1/1933 | Bone | 188/62 |
| 3,163,260 | 12/1964 | Brenner | 188/35 |
| 3,209,865 | 10/1965 | Wynn | 188/62 |
| 3,503,471 | 5/1970 | Balke | 188/57 |
| 3,705,554 | 12/1972 | Aksamit | 104/250 |
| 4,348,961 | 9/1982 | Rohrback | 104/252 |
| 4,433,628 | 2/1984 | Wakabayashi | 104/172 |
| 4,790,247 | 12/1988 | Summa | 104/172 |
| 4,901,648 | 2/1990 | Moore et al. | 104/250 |
| 5,388,525 | 2/1995 | Bodkin | 104/249 |

FOREIGN PATENT DOCUMENTS

| | | | |
|---|---|---|---|
| 1048759 | 12/1953 | France | 104/249 |
| 1248559 | 8/1967 | Germany | 104/252 |

OTHER PUBLICATIONS

"Safety Conveyors" Brochure, Acco Systems division of FKI Industries, published Prior to Oct. 11, 1995.

*Primary Examiner*—S. Joseph Morano
*Attorney, Agent, or Firm*—Barnes, Kisselle, Raisch, Choate, Whittemore & Hulbert, P.C.

[57] ABSTRACT

Apparatus for preventing runaway of trolleys in a power-and-free conveyor system that includes a friction bar that extends lengthwise of the free conveyor track on a side of the track remote from the power conveyor for motion lengthwise of the track at an acute angle to the direction of motion of the trolleys along the track. The friction bar is releasably biased laterally outwardly from the track and in a direction lengthwise of the track opposed to the direction of trolley motion on the track so that trolleys may travel freely along the free conveyor track past the bar. In the event that a trolley is traveling at excessive velocity along the tree conveyor track, the friction bar is moved in the direction of motion of the trolley and at the acute angle laterally into a position for frictional engagement with the trolley on the track, such that momentum of the trolley cooperates with frictional engagement of the bar with the trolley to wedge the bar against the trolley and arrest motion of the trolley on the track. Thus, momentum of the trolley along the track cooperates with angulated motion of the bar into frictional engagement with the trolley for automatically and inherently increasing frictional forces that arrest motion of the trolley on the track.

14 Claims, 5 Drawing Sheets

ANTI-RUNAWAY APPARATUS AND METHOD FOR A POWER-AND-FREE CONVEYOR SYSTEM

The present invention is directed to power-and-free conveyor systems, and more particularly to an apparatus and method for sensing and arresting runaway of conveyor trolleys in declined portions of such systems.

BACKGROUND AND OBJECTS OF THE INVENTION

Power-and-free conveyor systems conventionally include a plurality of carriers each consisting of one or more trolleys carried for free motion along a free conveyor track. A power conveyor is disposed either above the free conveyor track in an overhead system, or beneath the free conveyor track in an inverted system, for selective engagement with trolleys on the free conveyor track. In this way, the trolleys are propelled along the free conveyor track by engagement with the overlying or underlying power conveyor. A problem is encountered when the power conveyor becomes disengaged from the free conveyor trolleys, particularly on declined portions of the conveyor system. Under such conditions, gravitational forces on the trolley and the load carried thereby can increase trolley velocity to an uncontrolled runaway level. Various mechanisms have heretofore been proposed for preventing or arresting such a runaway condition. For example, it is conventional practice to position the power conveyor track closer to the free conveyor track in inclined portions of the conveyor system so that the pusher on the power conveyor will nest more deeply between the associated dogs on the free conveyor trolley. However, the power chain can break, or a chain surge or other malfunction can cause the trolley dogs to become disengaged from the power conveyor.

It has been proposed to provide a safety conveyor mechanism adjacent to the tree conveyor on declined portions of the conveyor system. The safety conveyor has retarder dogs that are positioned to be engaged in turn by the trolleys on the free conveyor track, and to prevent the trolley from running away in the event of power conveyor malfunction. Such a safety conveyor adjacent to each descent of a conveyor system greatly increases overall system cost and complexity. Another device for preventing trolley runaway heretofore proposed comprises a series of dogs pivotally disposed on the tree conveyor track in the area of each decline. The trolley normally engages each dog in turn as it passes, and each dog pivots upwardly out of the way and then swings back into position. However, if the trolley is traveling at an excessive speed, the dog is flipped completely over by the momentum of the trolley, and engages the trolley to block further movement. These dogs are less expensive than separate safety conveyors, but tend to jerk the trolley to a stop, potentially damaging the trolley, the system and the trolley load. It has also been proposed to provide a bar on the free conveyor track that is releasably movable laterally into engagement with the wheels or rollers that guide the trolley along the track. Such devices cause excessive wear to the trolley guide wheels, and do not take synergistic advantage of trolley momentum to arrest trolley motion.

It is a general object of the present invention to provide a method and apparatus for arresting a runaway trolley condition in a power-and-free conveyor system, particularly in declined portions of such a system, that are adapted to cooperate synergistically with momentum of a runaway trolley automatically to increase forces arresting the runaway trolley motion. A more specific object of the present invention is to provide a method and apparatus of the described character for arresting a trolley runaway condition in a power-and-free conveyor system that are economical to implement, that are readily adapted for both overhead and inverted power-and-free conveyor systems, that do not engage the trolley guide wheels or other moving parts of the trolley and thus reduce trolley wear, that gradually arrests trolley motion and thus do not cause undesirable jerking of the trolley and trolley load, and that are fail-safe in operation in that motion of trolleys along the conveyor decline will automatically be arrested in the event of system power failure.

SUMMARY OF THE INVENTION

Apparatus for preventing runaway of trolleys in a power-and-free conveyor system in accordance with a presently preferred embodiment of the invention includes a friction bar that extends lengthwise of the trolley free conveyor track on a side of the track remote from the power conveyor for motion lengthwise of the track at an acute angle to the direction of motion of the trolleys along the track. The friction bar is releasably biased laterally outwardly from the free conveyor track and in a direction lengthwise of the track opposed to the direction of trolley motion on the track so that trolleys may travel freely along the free conveyor track past the bar. In the event that a trolley is traveling at excessive velocity along the free conveyor track, the bar is moved in the direction of motion of the trolley and at the acute angle laterally into a position for frictional engagement with the trolley on the track, such that momentum of the trolley cooperates with frictional engagement of the bar with the trolley to wedge the bar against the trolley and arrest motion of the trolley on the track. Thus, momentum of the trolley along the track cooperates with angulated motion of the bar into frictional engagement with the trolley for automatically and inherently increasing frictional forces that arrest motion of the trolley on the track, while at the same time bringing the trolley gradually to a stop.

The bar is carried relative to the free conveyor track for frictional contact with the body of each trolley, rather than for contact with the trolley guide wheels or other portions on the trolley. In this way, trolley wear and system maintenance are reduced. Angulated motion of the friction bar is obtained by providing elongated slots at an acute angle lengthwise of the bar, and mounting the bar to the free conveyor track by means that extend through the slots for both guiding and restraining motion of the bar at the acute angle lengthwise of the bar. In the preferred embodiment of the invention, the friction bar is releasably biased to a position out of engagement with trolleys on the free conveyor track by a pneumatic cylinder coupled to one end of the bar and acting against the force applied by a coil spring coupled to the opposing end of the bar. In this way, in the event of excessive velocity at a trolley, or in the event of system power failure, the pneumatic cylinder is released and forces applied by the coil spring automatically move the bar longitudinally and laterally inwardly for frictional engagement with trolleys on the free conveyor track. When the condition that caused trolley runaway has been corrected, or when power is reapplied to the system, the pneumatic cylinder retracts the bar longitudinally and laterally outwardly from engagement with the trolleys and against the force of the coil spring for releasing the bar from frictional engagement with the trolleys.

In the preferred implementation of the invention along a declined portion of a power-and-free conveyor system, the conveyor decline has opposed end sections each at a constant radius of curvature leading into and out of the decline, and with or without a straight conveyor section that extends between and interconnects the curved end sections. The apparatus of the present invention in such preferred implementation includes first and second friction bars disposed at the end sections of the conveyor incline, and having radii of curvature that correspond to the radii of curvature of the-conveyor end sections. A third friction bar extends linearly along the third section of the free conveyor track, and is aligned at its opposed ends with the adjacent ends of the first and second bars. Each of the friction bars is mounted for motion at an acute angle to its length in the direction of the associated free conveyor track section. Each bar is coupled to an associated pneumatic cylinder for biasing the bar out of frictional engagement with trolleys on the adjacent tree conveyor track section, and has an associated coil spring for moving the bar into frictional engagement with trolleys on the adjacent track section when the cylinders are released.

In the preferred embodiment of the invention, proximity sensors are disposed adjacent to the free conveyor track, and are responsive to passage of conveyor trolleys adjacent thereto for determining velocity of conveyor trolleys along the track. The proximity sensors are coupled to an appropriate control for releasing the pneumatic cylinder(s), and thereby releasing the friction bar(s) for engagement with the conveyor trolleys, when trolley velocity exceeds a preselected threshold. For example, for conveyor trolleys that normally operate at a speed of sixty feet per minute, the cylinder(s) may be released at a detected trolley speed of seventy feet per minute.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
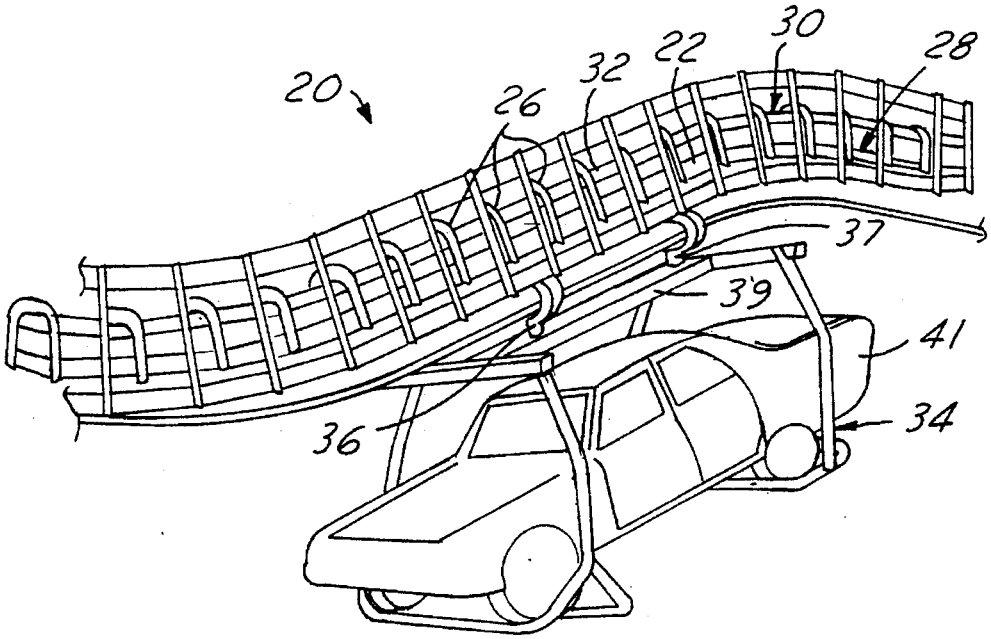
FIG. 1 is a fragmentary perspective view of a power-and-free conveyor system incline in accordance with a preferred implementation of the present invention.
Figure 2:
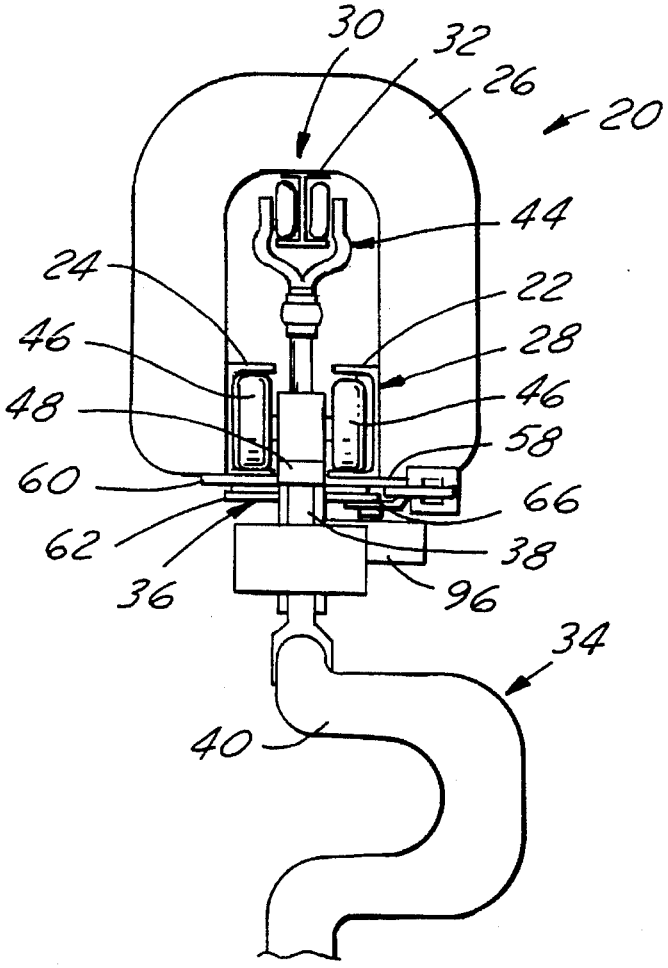
FIG. 2 is a fragmentary sectional view of the system illustrated in FIG. 1.
Figures 3, 5, 8:
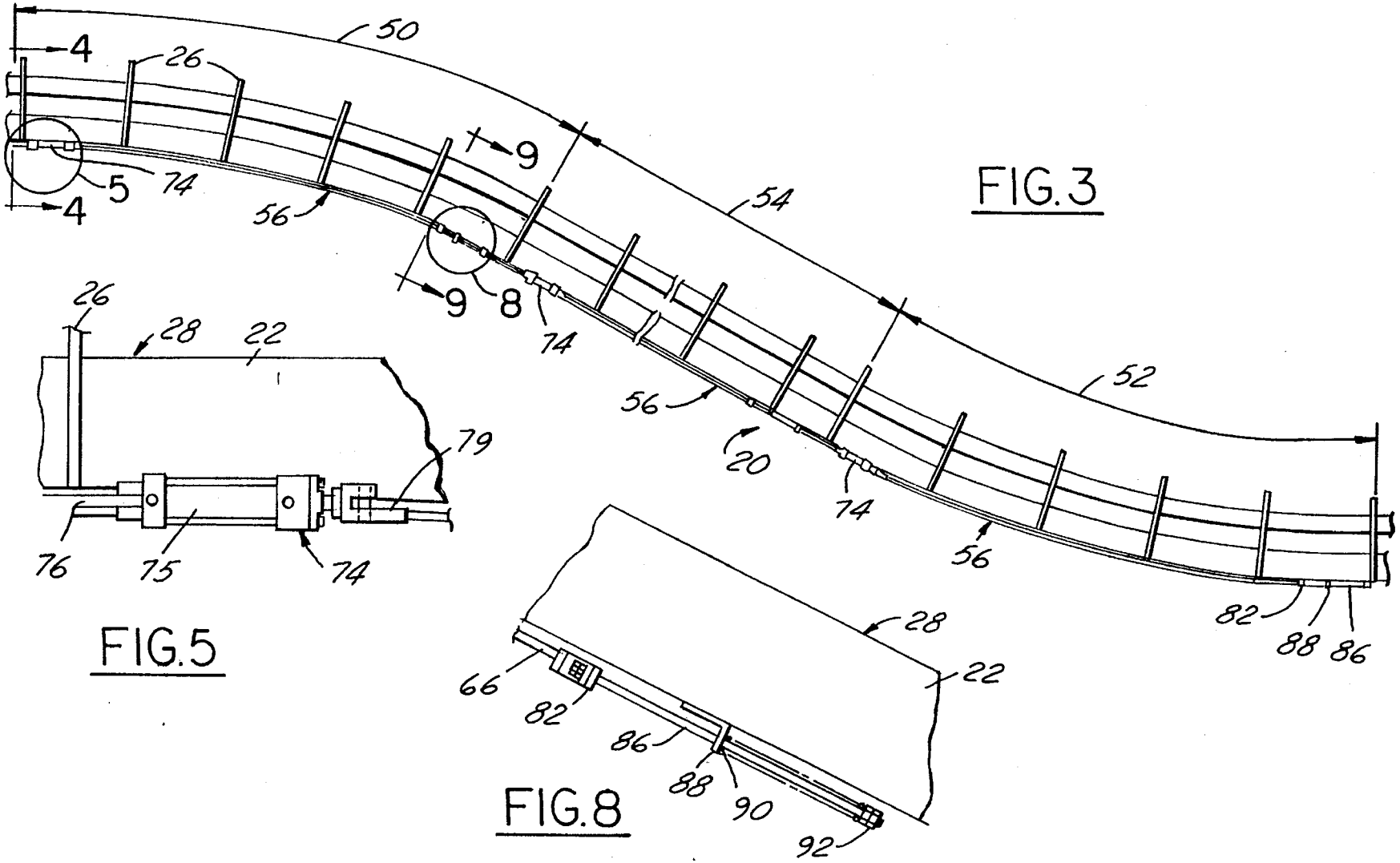
FIG. 3 is a fragmentary elevational view of a presently preferred embodiment of the invention implemented in the conveyor system incline illustrated in FIG. 1.
FIG. 5 is an elevational view on an enlarged scale of the portion of FIG. 3 within the circle 5.
FIG. 8 is a fragmentary elevational view on an enlarged scale of the portion of FIG. 3 within the circle 8.

The drawings illustrate a presently preferred implementation of the invention in a decline section of a power-and-free conveyor system 20 (FIGS. 1–3). System 20 includes a pair of opposed C-shaped channel sections 22, 24 interconnected by a series of yokes 26 to form a free conveyor track 28. A power conveyor track 30 includes an I-beam 32 mounted on yokes 26 above track 28 and in the mid-plane between track sections 22, 24. A carrier 34 is formed by a lead trolley 36 and a trailing trolley 37 interconnected by a carrier load bar 39 that supports a conveyor load, illustrated in FIG. 1 as an automobile body 41. Trolley 36 (FIG. 2) includes a trolley body 38 supported by laterally opposed pairs of fore and aft load wheels 46 that ride within opposed free conveyor track sections 22, 24. Trolley body 38 also carries a pair of longitudinally spaced guide wheels 48 that engage the opposed lower flanges of track sections 22, 24 for maintaining orientation of the trolley. A power conveyor 44 rides on power conveyor track 30, and has pushers that engage dogs carried by trolley 36 for propelling carriers 34 in sequence along free conveyor track 28. To the extent thus far described, power-and-free conveyor system 20 is generally of conventional construction.

Figure 4:
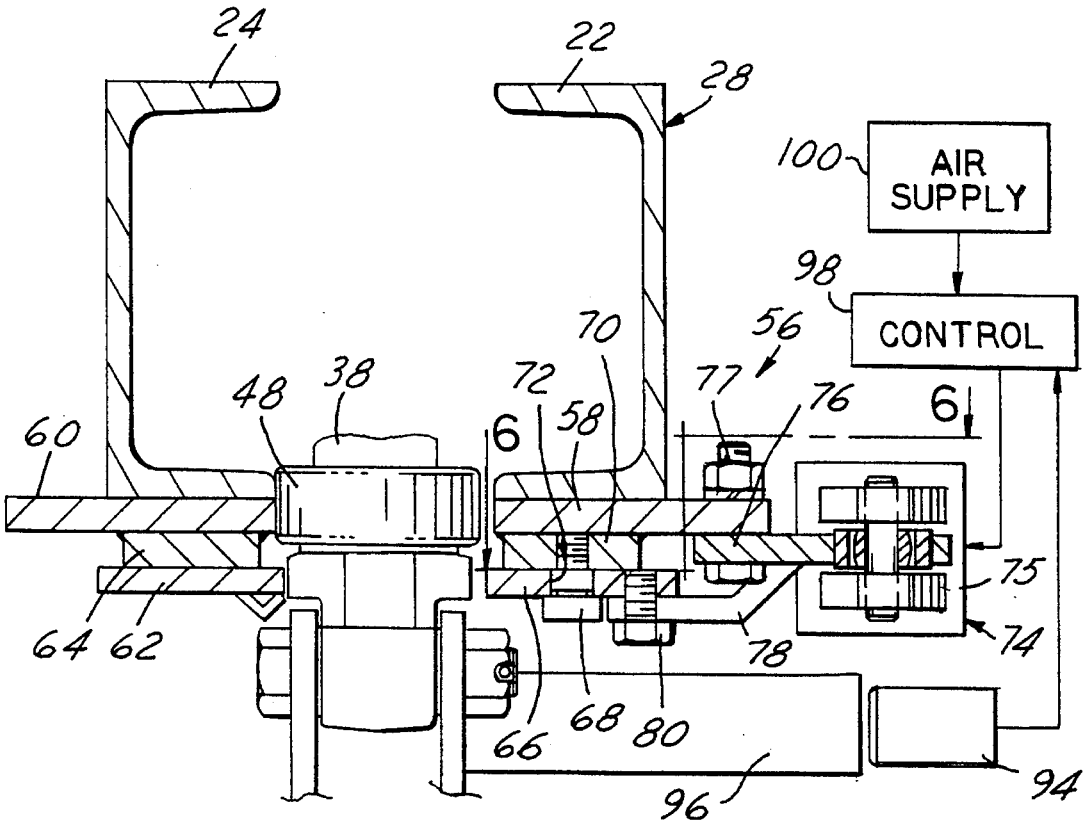
FIG. 4 is a sectional view taken substantially along the line 4—4 in FIG. 3.
Figure 9:
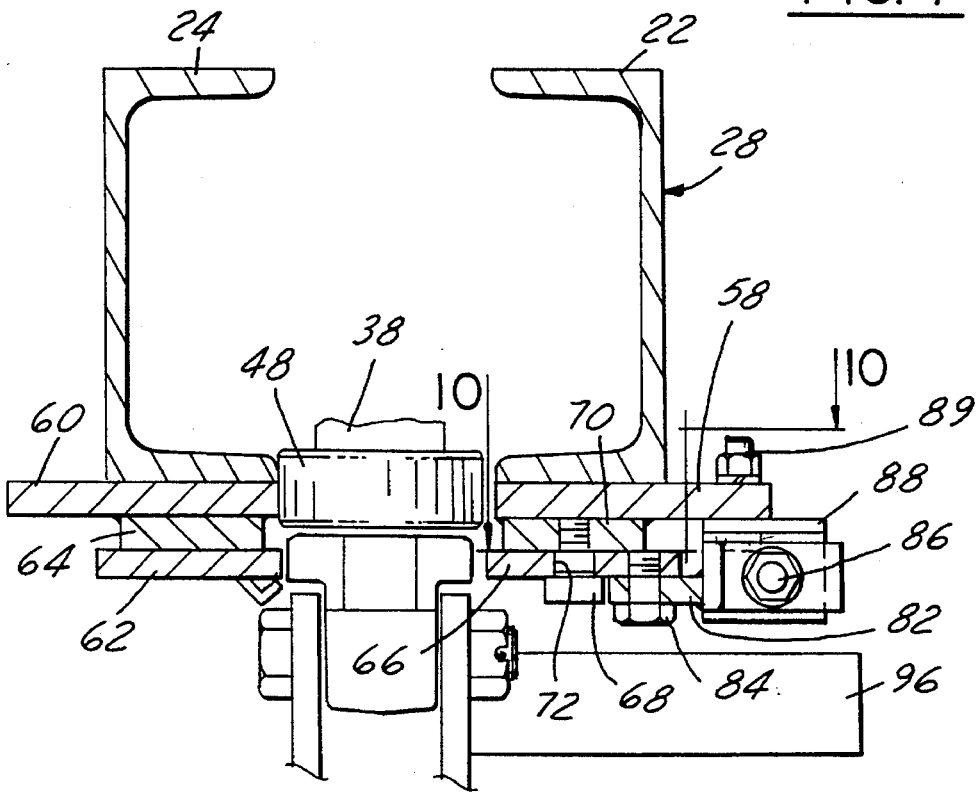
FIG. 9 is a fragmentary sectional view taken substantially along the line 9—9 in FIG. 3.
Figure 6:
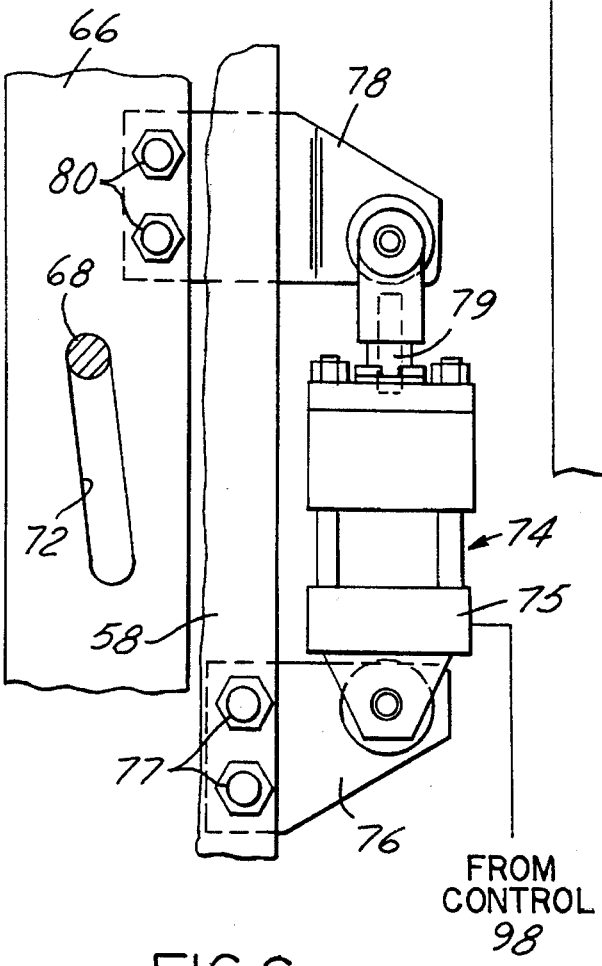
FIG. 6 is a fragmentary sectional view taken substantially along the line 6—6 in FIG. 4 and showing the apparatus of the invention in retracted position.
Figure 7:
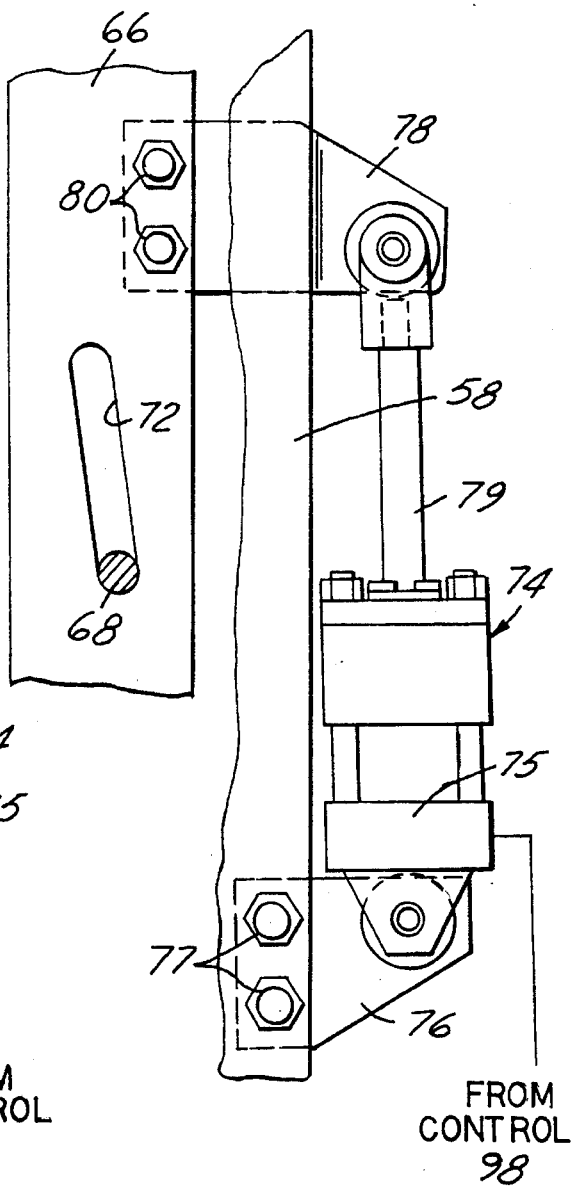
FIG. 7 is a fragmentary sectional view similar to that of FIG. 6 but showing the apparatus of the invention in released position.
Figure 10:
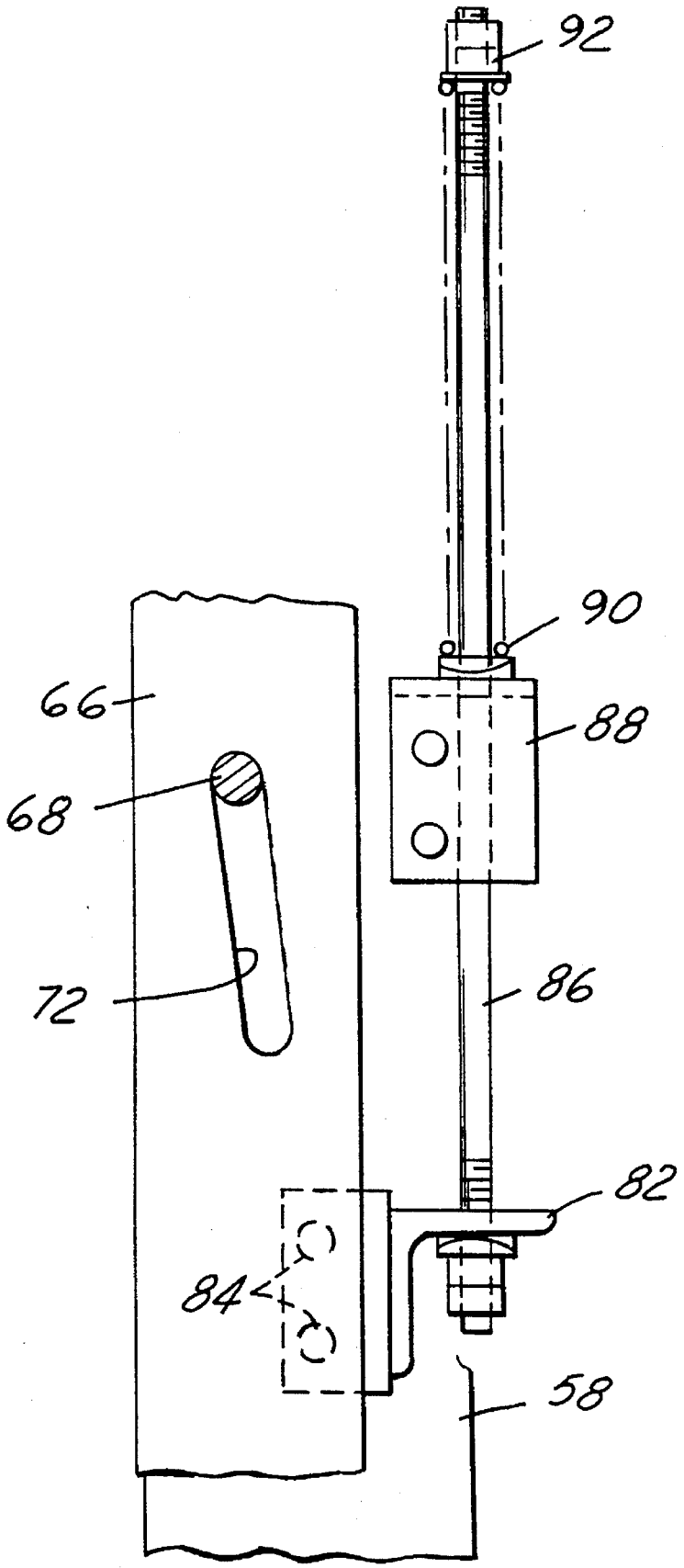
FIG. 10 is a fragmentary sectional view taken substantially along the line 10—10 in FIG. 9.

As illustrated in greater detail in FIG. 3, the decline section of conveyor system 20 includes a first portion or section 50 and a second portion or section 52 at respective uniform radii of curvature disposed at the respective ends of the conveyor decline section, and a third linear portion or section 54 that interconnect sections 50, 52 to determine overall length of the decline. In each section 50, 52, 54, an apparatus 56 in accordance with the present invention is disposed for arresting a conveyor runaway condition. Apparatus 56 disposed in section 50 will be described in detail in connection with FIGS. 4–10, it being understood that apparatus 56 disposed in sections 52 and 54 are identical thereto but for the radius of curvature of the friction bar and associated mounting structure. Referring to FIG. 3, 4 and 9, a pair of reenforcing bars 58, 60 are conventionally welded or otherwise affixed to the bottom flanges of track sections 22, 24 to reenforce the track sections in inclined sections of the free conveyor track. In accordance with the present invention, apparatus 56 includes a stationary friction bar 62 (FIGS. 2, 4 and 9) affixed by one or more spacers 64 to reenforcing bars 60 beneath track section 24. A second friction bar 66 is affixed by a longitudinal series of shoulder bolts 68 to a spacer bar 70 that is mounted to reenforcing bar 58 beneath track section 22. Friction bars 62, 66 are roll formed to match the contour of the conveyor section in which they are mounted—i.e., are curved in track sections 50, 52 and straight in track section 54—so as to be parallel to the longitudinal direction of trolley motion in each of the track sections.

Bar 66 has a longituionally spaced series of angulated slots 72 (FIGS. 4, 6, 7 and 9–10), through which the shoulder portions of shoulder bolts 68 are slidably received, so that bar 66 is movably captured by bolts 68 on bar 70. Slots 72 are at an acute angle to the longitudinal dimension of track 28, and to the direction of motion of trolleys on free conveyor track 28, which is from left to right in FIG. 3, into the page in FIGS. 4 and 9, and upward in FIGS. 6, 7 and 10. The angle of slots 72 with respect to the longitudinal axis of track 28 preferably is about seven degrees. The longitudinal dimension of slots 72 is such that bar 66 is slidable with respect to shoulder bolts 68 between a laterally outwardly retracted position illustrated in FIGS. 4, 6, 9 and 10 spaced from the laterally opposed body 38 of trolley 36, and an inward activated or released position illustrated in FIG. 7 at which the inner edge of bar 66 is positioned for frictional engagement with body 38 of trolley 36. In latter position, bar 66 pushes trolley body 38 into frictional engagement with the opposing edge of stationary friction bar 62 (FIGS. 4 and 9).

A pneumatic cylinder 74 (FIGS. 3–7) is mounted at one end of each movable friction bar 66. Each cylinder 74 has a body 75 pivotally coupled to a bracket 76 that is affixed by bolts 77 to the adjacent reinforcing bar 58, and an extensible rod 79 pivotally coupled to a bracket 78 that is fastened by bolts 80 to friction bar 66. The cylinder body and rod are pivotally coupled to the brackets to accommodate the angulated motion of the friction bar. At the opposing end of each friction bar 66, a bracket 82 is affixed to the friction bar by bolts 84. A rod 86 extends from bracket 82 slidably through a bracket 88 that is affixed to reenforcing bar 58, thus being fixed with respect to the structure of the conveyor. A coil spring 90 is captured in compression surrounding rod 86 between bracket 88 and nuts 92 threaded onto the free end of rod 86. Nuts 92 accommodate adjustment of the compressed spacing three. A series of proximity sensors 94 (FIG. 4) are disposed in fixed position along the path of travel of the trolleys so as to sense passage of a pusher bar 96 (FIGS. 4 and 9) carried by each trolley. Proximity sensors 94 are at uniform spacing along the conveyor, and are all connected to a controller 98 that includes suitable valves for selectively feeding air from a supply 100 to all pneumatic cylinders 74.

During normal operation, all pneumatic cylinders 74 are energized and retracted so as to pull friction bars 66 longitudinally and laterally outwardly from the path of travel of trolleys 36—i.e., to the positions shown in FIGS. 4–6 and 8–10. At such disposition of pneumatic cylinders 74 and friction bars 66, each friction bar is pulled against the compressive force of the associated coil spring 90, which is to say that each pneumatic cylinder 74 holds its associated friction bar 66 out of frictional engagement with the trolleys against the force of the associated coil spring 90. If the trolleys are traveling at the specific predetermined desired rate of travel (e.g., sixty feet per minute), a specific predetermined associated time is required for travel between adjacent proximity sensors 94. Under such conditions, pneumatic cylinders 74 are held retracted and springs 90 remain compressed. However, if the time of travel between adjacent proximity sensors is too low (e.g., at a trolley speed of seventy feet per minute), this is interpreted by controller 98 as a runaway condition. Controller 98 then releases all cylinders 74, and each friction bar 66 is then urged longitudinally by the force applied by the associated coil spring 90. Angulated orientation of slots 72 cooperates with shoulder bolts 68 so that friction bars 66 move under the force of coil springs 90 both longitudinally of track 28 and laterally toward the path of travel of trolleys on track 28. When the edges of friction bars 66 engage the body of any trolleys traveling within the associated track section, the momentum of the trolley body urges the friction bar to travel further in the direction in which it is urged by its associated coil spring. In this way, the momentum of the trolley cooperates with the angulated motion of the friction bar to wedge the bar against the trolley, and thereby gradually arrest motion of the trolley. Even if no overspeed condition is sensed by the proximity sensors in cooperation with controller 98, loss of pneumatic power at the conveyor will automatically release cylinders 74, so that any such power failure results in a safe condition at the conveyor. After system repair or other corrective action to eliminate any trolley runaway condition, controller 98 reactivates pneumatic cylinders 74, so that friction bars 66 are pulled against the forces of springs 90, and against the wedged frictional forces between the friction bars and the trolley bodies, to return each anti-runaway apparatus 56 to its original or deactivated position.

The trolley-engaging edges of friction bars 62, 66 may receive a wear-resistant treatment or coating, and/or may be textured or serrated for enhanced frictional engagement with the trolley bodies. The anti-runaway apparatus of the invention may be employed in connection with inverted conveyor systems, as well as overhead systems as illustrated.

We claim:

1. In a power-and-free conveyor system that includes a tree conveyor track, at least one trolley carried for free motion along said free conveyor track, said trolley including a trolley body and rollers on said body for supporting and guiding engagement with said track, and a power conveyor spaced vertically from said free conveyor track and selectively engageable with trolleys on said free conveyor track for propelling said trolleys along said track, apparatus for preventing runaway of trolleys comprising:

a bar extending lengthwise of said track and means mounting said bar on a side of said track remote from said power conveyor for motion lengthwise of said track at an acute angle to the direction of travel of said trolley on said track, means for releasably biasing said bar laterally outwardly of said track and in a direction lengthwise of said track opposed to the direction of said trolley travel on said track, and means responsive to velocity of travel of said trolley on said track for moving said bar in the direction of travel of said trolley and at said acute angle laterally into a position for frictional engagement with said trolley body on said track, such that momentum of said trolley cooperates with frictional engagement of said bar with said trolley body to wedge said bar against said trolley and arrest motion of said trolley on said track.

2. The system set forth in claim 1 wherein said bar includes longitudinal slots at said acute angle lengthwise of said bar, and wherein said mounting means includes means extending through said slots for both guiding and restraining motion of said bar at said acute angle lengthwise of said bar.

3. The system set forth in claim 2 wherein said releasably biasing means includes a pneumatic cylinder coupled to said bar, and wherein said means for moving said bar includes spring means coupled to said bar urging said bar longitudinally and laterally at said acute angle to a position for frictional engagement with said trolley.

4. The system set forth in claim 2 wherein said biasing means includes means for retracting said bar longitudinally and laterally outwardly at said acute angle following activation of said velocity-responsive means for releasing said bar from frictional engagement with said trolley.

5. The system set forth in claim 1 for mounting along a declined section of said power-and-free conveyor system having opposed end sections each at constant radius leading into and out of said declined section, and a straight intermediate section between said end sections, said apparatus comprising:

first and second said bars disposed on said end track sections and having radii of curvature corresponding to those of said end sections, and a third said bar extending along said intermediate track section, and separate biasing and velocity-responsive means for each of said bars.

6. The system set forth in claim 1 wherein said means responsive to velocity of said trolley includes means for sensing velocity of said trolley on said track, and means for moving said bar into a position for wedging frictional engagement with said trolley when said velocity exceeds a preselected threshold.

7. The system set forth in claim 6 wherein said means responsive to velocity includes proximity sensors responsive to passage of said trolley on said track.

8. The system set forth in claim 1 further comprising a second bar extending lengthwise of said track and means mounting said second bar on a side of said track such that said trolley travels between said bars, said second bar being disposed for frictional engagement with said trolley body in opposition to said first bar.

9. The system set forth in claim 8 wherein said second bar is mounted in fixed position on said track.

10. A method of arresting runaway motion of a trolley on a free conveyor track of a power-and-free conveyor system that comprises the steps of:

(a) mounting a trolley body on rollers for free motion along the free conveyor track, (b) sensing velocity of motion of the trolley body lengthwise of said track, and (c) when said velocity reaches a preselected threshold, moving a bar longitudinally and laterally into frictional contact with said trolley body at an acute angle to the direction of motion of said trolley body on said track such that momentum of said trolley body cooperates with frictional engagement between said bar and said trolley body to wedge said bar against said trolley body.

11. In a power-and-free conveyor system that includes a free conveyor track, at least one trolley carried for free motion along said free conveyor track, and a power conveyor spaced vertically from said tree conveyor track and selectively engageable with trolleys on said free conveyor track for propelling said trolleys along said track, apparatus for preventing runaway of trolleys along a declined section of the power-and-free conveyor system having opposed end sections each at constant radius leading into and out of said declined section and a straight intermediate section between said end sections, said apparatus comprising:

a bar extending lengthwise of said track and means mounting said bar on a side of said track remote from said power conveyor for motion lengthwise of said track at an acute angle to the direction of travel of said trolley on said track, including first and second said bars disposed on said end track sections and having radii of curvature corresponding to those of said end track sections and a third said bar extending along said intermediate track section, means for separately releasably biasing each said bar laterally outwardly of each said track section and in a direction lengthwise of said track opposed to the direction of trolley travel on said track, and means separately responsive to velocity of travel of said trolley on each said track section for moving said bars in the direction of travel of said trolley and at said acute angle laterally into a position for frictional engagement with said trolley on each said track section, such that momentum of said trolley cooperates with frictional engagement of each said bar with said trolley to wedge the bar against said trolley and arrest motion of said trolley on said track section.

12. The system set forth in claim 11 wherein said trolley includes a trolley body and rollers on said body for supporting and guiding engagement with said track, and wherein each said bar is mounted on each said track section for frictional engagement with said trolley body.

13. The system set forth in claim 12 further comprising fourth and fifth bars extending along said end track sections on sides thereof opposite said first and second bars and having radii of curvature corresponding to those of said end track sections, and a sixth bar extending along said intermediate track section on a side thereof opposite said third bar, said first, second and third bars on one side of said track sections and said fourth, fifth and sixth bars on the opposing side of said track sections being disposed for opposed frictional engagement with the body of said trolley.

14. The system set forth in claim 13 wherein said fourth, fifth and sixth bars are mounted in fixed position on said track sections.

* * * * *